US005584484A

United States Patent [19]

Kenvyn

[11] Patent Number: 5,584,484

[45] Date of Patent: Dec. 17, 1996

[54] BOARD GAME APPARATUS

[76] Inventor: John Kenvyn, Gerard Doustraat 141C, NL-1073-VV Amsterdam, Netherlands

[21] Appl. No.: 523,827

[22] Filed: Sep. 6, 1995

[30] Foreign Application Priority Data

Sep. 28, 1994 [IE] Ireland ..... S94 0782

[51] Int. Cl.[6] ..... A63F 3/00

[52] U.S. Cl. ..... 273/243

[58] Field of Search ..... 273/242, 243, 273/248, 249, 429, 430, 431, 432

[56] References Cited

U.S. PATENT DOCUMENTS

| | | | |
|---|---|---|---|
| 3,984,106 | 10/1976 | White . | |
| 4,889,344 | 12/1989 | Zimba . | |
| 5,013,048 | 5/1991 | Turner | 273/242 |
| 5,071,134 | 12/1991 | Burroughs | 273/249 |
| 5,121,928 | 6/1992 | Salerno-Sonneberg | 273/243 |
| 5,273,431 | 12/1993 | Charouhas | 273/243 X |
| 5,295,834 | 3/1994 | Saunders | 273/249 X |
| 5,297,801 | 3/1994 | Croker | 273/240 X |
| 5,350,179 | 9/1994 | Hill et al. | 273/249 |

FOREIGN PATENT DOCUMENTS

| | | | |
|---|---|---|---|
| 2161083 | 8/1986 | United Kingdom . | |
| 2189159 | 10/1987 | United Kingdom | 273/243 |
| 2199253 | 6/1988 | United Kingdom . | |
| 2249486 | 5/1992 | United Kingdom | 273/243 |

*Primary Examiner*—William E. Stoll

*Attorney, Agent, or Firm*—Jacobson, Price, Holman & Stern, PLLC

[57] ABSTRACT

A board game apparatus is used in play as a tool to route the players to any desired information source such as a dictionary or a number of dictionaries of different levels of detail or language. The board has a number of endless playing paths (3) made up of marked spaces (8), each of which is associated with a general, word-related task. A player must perform a task as indicated by the code on the marked space upon which the playing piece rests. A set of tokens (30) have the same coding scheme and are used to register successful completion of tasks. There is also a set of auxiliary spaces (7) associated with auxiliary features of the game which are performed using a set of auxiliary cards (20). These auxiliary features are therefore provided in a modular fashion and may be omitted if desired by the players by simply ignoring the auxiliary spaces 7. The game is not limited to a particular set of tasks provided in the apparatus and the apparatus is therefore not regarded as an end in itself, but merely a tool or routing device to allow enjoyable use of knowledge sources for both education and fun.

10 Claims, 4 Drawing Sheets

BOARD GAME APPARATUS

INTRODUCTION

1. Field of the Invention

The invention relates to board games. More particularly, the invention relates to board games which provide enjoyment for players with an educational aspect being involved in the playing.

2. Prior Art Discussion

An example of such a board game is described in U.S. Pat. No. 4,889,344. A dictionary is included with this apparatus and there is a set of cards which include questions and which also indicate where the answers are to be found in the dictionary. Marked spaces on the board define a peripheral path around the board and are used to determine selection of cards for players to progress in the game. British Patent Specification No. GB 2,161,083 includes a picture dictionary for each player. The object of the game is to spell out words for a picture playing member which includes pictures for the words to be written. British Patent Specification No. GB 2,199,253 includes a board having interconnecting circuits and an object of the game is to home in to the end of the circuit. The circuit provides a maze in which progress is made depending on word puzzles represented by symbols on game cards. There are 1100 such game cards. U.S. Pat. No. 3,984,106 describes a game in which marked spaces on the path have letters printed on them. These letters determine the task to be undertaken by a player such as formation of a word with that letter as the first letter.

While all of the above board games appear to provide enjoyment for players, they suffer from some disadvantages. One such disadvantage is the fact that there is limited variety in playing of the game. For example, the tasks to be undertaken by a player are set either on the playing path (such as in U.S. Pat. No. 3,984,106) or on cards which are supplied with the game (such as in U.S. Pat. No. 4,889,344 and GB 2,199,253) or on an item such as a picture playing member as in GB 2,161,083. Accordingly, as players become familiar with the game, the game can lose its interest and over a period of time there is little challenge presented to the players.

Further, there is little versatility as the games are pitched at particular age groups. For example, GB 2,161,083 appears to be directed towards children, whereas that described in GB 2,199,253 appears to be directed towards adults.

OBJECT OF THE INVENTION

It is an object of the invention to provide a board game apparatus which provides versatility in that it may be played by both children and adults, preferably simultaneously and whereby the game does not lose interest for players over a period of time.

Another object is that the game be relatively simple to play and may be quickly and easily understood by all players.

SUMMARY OF THE INVENTION

The invention provides a board game apparatus which has a number of individually distinguishable playing pieces and a board which has marked spaces defining at least one endless path. At least some of the spaces are marked with a task code, which may be a colour code. The apparatus also includes a guide means such as a cue card indicating a general, word-related task associated with each task code.

Each general, word-related task is to be performed with an external information source such as a dictionary to be chosen by the players. Indeed, there may be a number of dictionaries used. There is a number of tokens, each of which is associated with a task. These tokens are for use in recording successful completion by a player of the associated tasks which are undertaken by a player when his or her playing piece rests on a space. For example, when a player's playing piece rests on a space marked blue, the player may undertake a general word-related task associated with the letter blue and if he/she successfully completes that task, a blue token is given to the player to record this. The apparatus also includes a die for use in providing a random factor in determining the space on which the playing piece is to rest.

The combination of the fact that the spaces are marked with task codes, which are also related to general, word-related tasks of the instruction means, and the tokens marked with the task codes provides a large degree of variety. For example, there is a wide scope for players in determining the nature of the tasks to be undertaken, the task codes simply providing a general guide within which there is room for players to decide on the specific nature of the task. A task may specify that the player should spell out a word which is given in a dictionary, however, the dictionary may be a children's dictionary or alternatively a very sophisticated dictionary, as decided by the players. The information source may be of any desired type. In essence, it could be said that the apparatus provides a tool whereby any desired information source may be used by players to play a very enjoyable game with a good educational aspect. The informational content of the game is limited only by the information sources which are provided by the players. It may therefore be said to be effectively limitless.

In one particular embodiment, the apparatus also includes a number of requirement indicator cards, each card providing a number associated with each of the task codes. This number specifies the number of task codes to be performed by a player for successful completion of the game. This provides additional fun to playing of the game as each player will want to perform certain tasks and will therefore hope that his/her playing piece will land on a space with those task codes. Preferably, all of the cards have the same mathematical relationship such as the same total number so that there is the same total number of tasks to be undertaken by each player, the breakdown of the tasks possibly being different.

In another embodiment, there are a number of intersecting paths on the board, whereby junctions of the paths provide alternative routes for playing pieces. In this way, the throw of the dice provides a random factor in determining where the playing piece is to rest, but is not the only factor. If the player is close to an intersection, he/she may choose to take one of two or possibly three alternative routes. This adds a good deal of interest and enjoyment to the game.

BRIEF DESCRIPTION OF THE DRAWINGS

The invention will be more clearly understood from the following description of some embodiments thereof, given by way of example only, with reference to the accompanying drawings, in which.

DETAILED DESCRIPTION OF THE INVENTION

Figure 1:
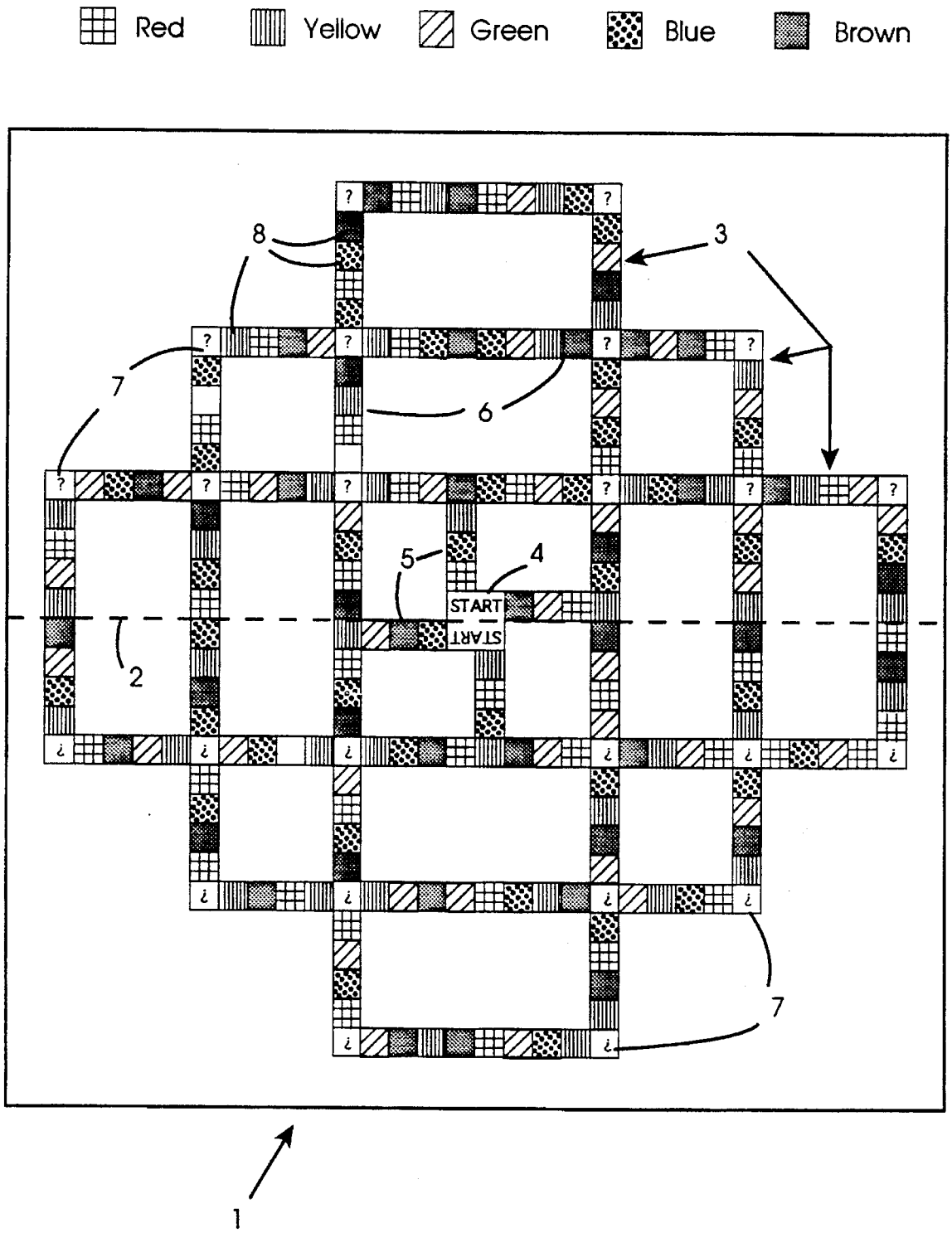
FIG. 1 is a plan view of a board of the board game apparatus of the invention.

Referring to the drawings, there is shown a board game apparatus of the invention comprising a board indicated generally by the reference numeral 1. The board 1 has a fold-line 2 indicated by an interrupted line. The board 1 is simple in its layout as it defines only a number of paths. These paths comprise three endless playing paths 3, namely two rectangular paths 3 arranged generally perpendicular to each other and a square path. There is a central START space 4 from which extend four radial paths 5 which connect the START space 4 with the two rectangular paths 3.

The paths 3 and 5 comprise marked spaces which fall into two broad categories. The first category comprises spaces 8 which are marked with task codes. In this embodiment, the task codes are colours red, yellow, green, blue and brown. These colours are represented by patterns as illustrated at the top of FIG. 1. Each of the colours is associated with a task and hence the term "task code". The nature of these tasks is described below. The second category of marked space comprises a number of auxiliary spaces 7 which are marked with a question mark.

Figure 2:
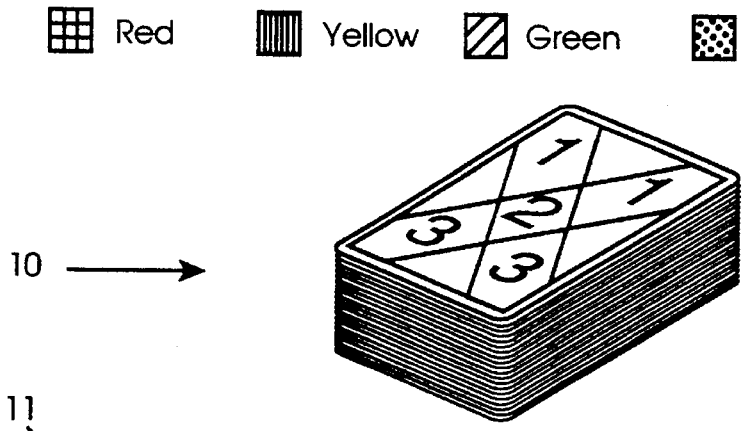
FIG. 2(*a*) is a perspective view of a stack of requirement indicator cards, and FIG. 2(*b*) is a plan view of four of these cards.
Figure 2:
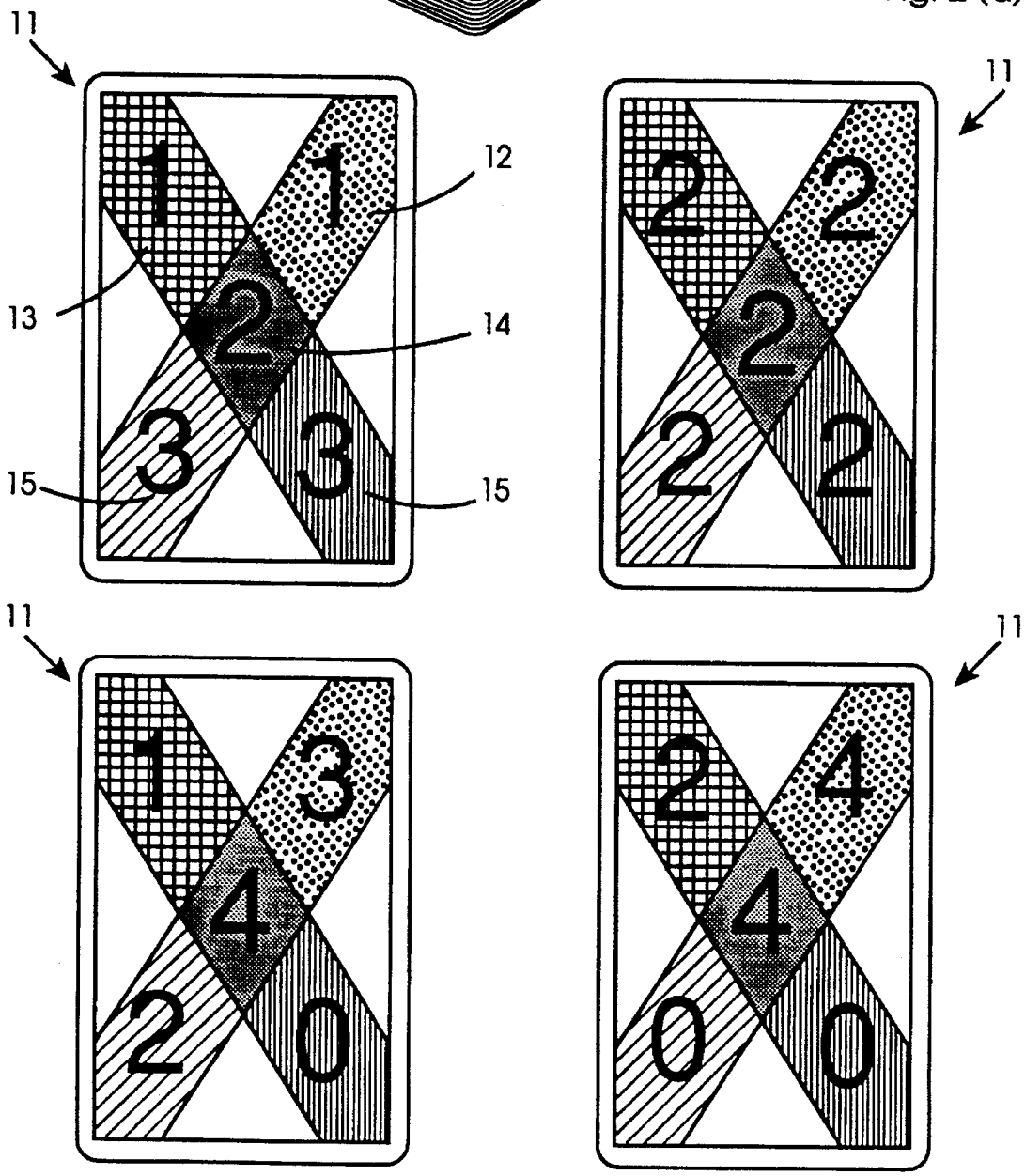

Referring specifically to FIGS. 2(*a*) and 2(*b*), the apparatus also comprises a set of requirement indicator cards 10. One side of the cards 10 has a cross pattern formed by a line 12 extending from the bottom left hand corner to the top right hand corner and a line 13 extending from the bottom right hand corner to the top left hand corner. The lines 12 and 13 intersect at a diamond-shaped space 14. Each of the lines 12 and 13 comprises a space 15 on each side of the diamond-shaped space 14. As represented in the drawings, each of the spaces on each card 11 has a background colour of one of the task codes, namely red, yellow, green, blue or brown. In the foreground colour of black each space is marked with a numeral. The total of all the numerals on each card 11 is ten, however, the break-down of these numerals is different as shown by the four examples in FIG. 2(*b*). These numerals indicate the number of tasks to be performed by a player for each code.

The opposite side of the cards 11 do not have indicia for the game. They have a red background with the FACTOID™ name in black at the top right corner and the word INDICATOR across the middle in white lettering.

Figure 3:
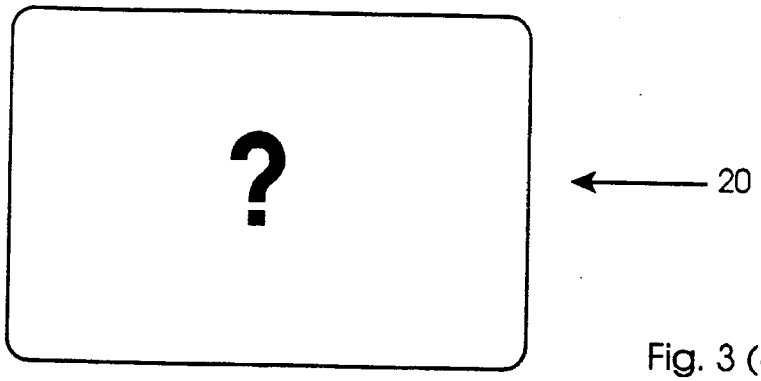
FIG. 3(*a*) is a plan view of one side of an auxiliary card, FIG. 3(*b*) showing the other side of six of these cards.
Figure 3:
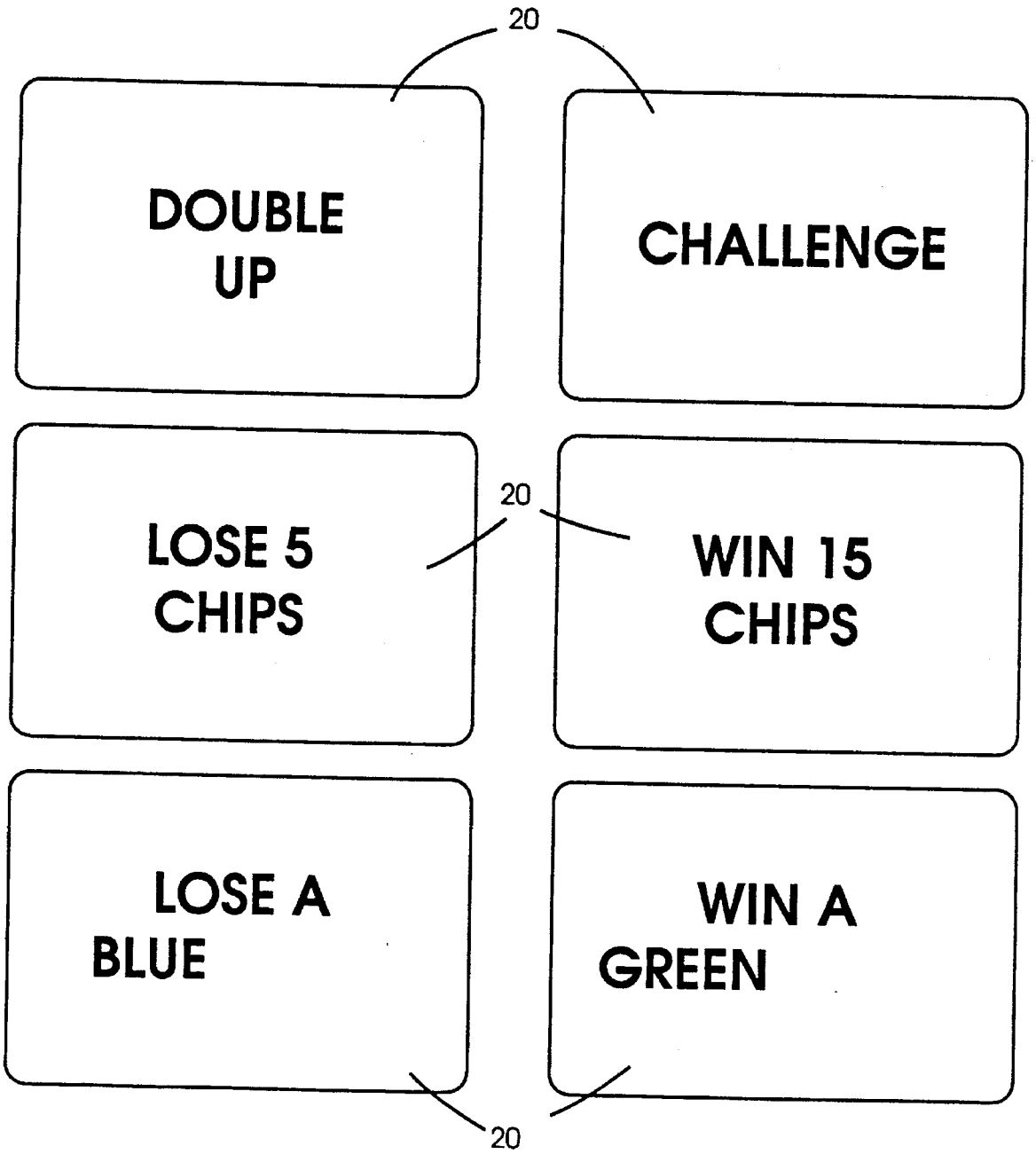

Referring now to FIGS. 3(*a*) and 3(*b*), a number of auxiliary cards 20 is shown. The front face of each auxiliary card is marked with a question mark as shown in FIG. 3(*a*). This corresponds with the indicia on the auxiliary spaces 7 of the board 1. The reverse side of each of the auxiliary cards 20 indicates an auxiliary action such as DOUBLE UP, CHALLENGE, LOSE 5 CHIPS, WIN 15 CHIPS, LOSE A BLUE, or WIN A GREEN.

Figure 5:
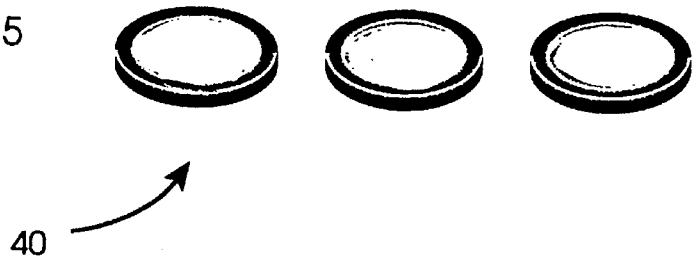
FIG. 5 is a perspective view showing point counters.
Figure 4:
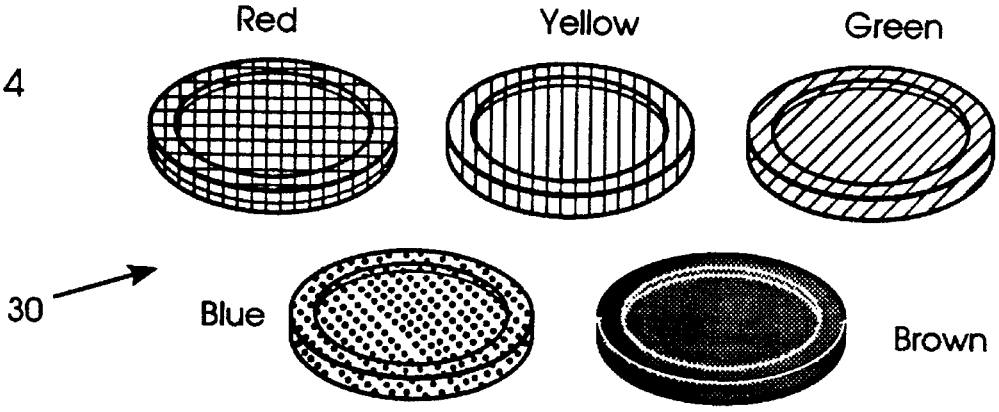
FIG. 4 is a perspective view showing five task tokens.
Figure 6:
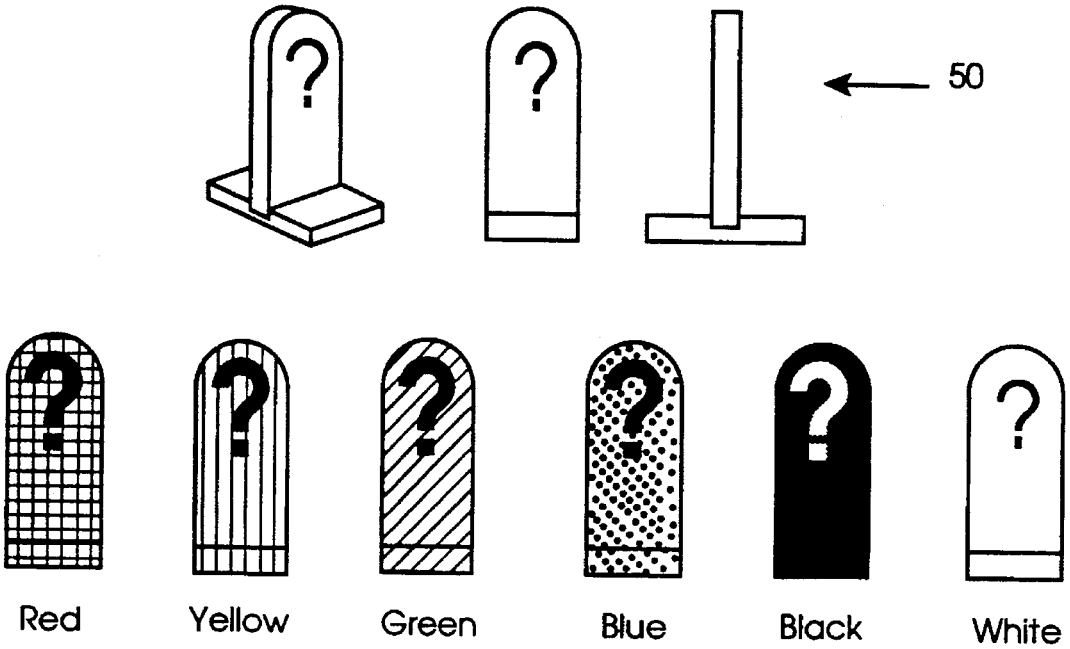
FIG. 6 are various views showing playing pieces.
Figure 7:
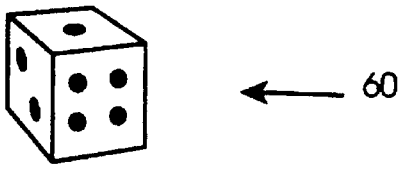
FIG. 7 is a perspective view showing a die of the apparatus.

The apparatus also comprises a number of tokens associated with each task code. These tokens are coloured with the associated task code colour and one of each of the sets of tokens is shown in FIG. 4 and indicated by the numeral 30. There is also a set of point counters which are all white in colour and are smaller than the tokens 30. These are shown in FIG. 5 and indicated by the numeral 40. As shown in FIG. 6, there is a number of playing pieces 50 and a die 60 for use in playing the game is shown in FIG. 7.

To play a game, the players must initially choose an external information source such as a dictionary or any other book. The dictionary may be chosen according to the level at which the game is to be pitched and indeed it is possible to use a number of different information sources such as a children's dictionary for the children who are playing and an advanced dictionary for the adults if both adults and children are to play the game. It will therefore be immediately appreciated that there is a large amount of versatility in the playing of the game. An important point is that the game may be played both in a serious or relaxed manner, but is always entertaining and educational because people can have fun while learning many aspects relating to a language of their choice and how to use that language to their benefit.

Before beginning a game, each player is informed of the nature of the tasks if they are not already aware of them. This may be done by use of a cue card. Each of the tasks is a general, word-related task which relates to the information source. Each player is also given a playing piece 50 and an indicator card 11. A "banker" holds the remaining indicator cards 11, the set of auxiliary cards 20, the point counters 40 and the tokens 30. The number of indicator cards 11 and tokens 30 depends on the number of people taking part in the game. The banker initially gives each player point counters 40 representing in this case twenty points. All players start from the START space 4 and the first player throws the die 60 to randomly determine a number. This number indicates the number of spaces by which the player may move his/her playing piece.

Initially, the playing piece 50 is moved out on a radial path 5 for four spaces and if the number is higher than 4, the player may choose from two alternative routes going left or right on the first rectangular path 3. The player will look at his/her indicator card and determine the balance of the various codes involved. For example, if the numeral 4 is over the task code colour blue as shown in FIG. 2(*b*), then the player will attempt to land on a blue space as he knows that there is a relatively high number of blue tasks to be undertaken. Alternatively, as shown in the bottom right-hand corner of FIG. 2(*b*), if there is a numeral zero on a colour such as the colours green and yellow, the player will attempt not to land on such a space. By virtue of the fact that the player may have alternative routes presented to him, the throw of the die provides a random factor in determining the space upon which the playing piece will rest, but not the only factor. The radial paths 5 are used at the start of the game and once the player has moved beyond the radial paths 5, he may move on the endless paths 3, however, there will be ample opportunity to move to other paths at the twelve intersections.

When the playing piece rests on a particular marked space 8, the player must attempt to perform a task associated with that code. These are as follows:

First Step:

The dictionary holder (usually the person to the left of the player) proceeds to leaf through the dictionary until told to stop by the player.

Second Step:

Without being able to see the pages which are open, the player chooses by number a column of the pages.

Third Step:

The player chooses by number a word from the column.

These steps are common to all of the tasks. From this point onwards;, the tasks are different depending on the code. The following describes the tasks according to their codes:

Red:

The dictionary holder reads out the word with its correct pronunciation. The player must spell the word.

Blue:

The dictionary holder reads out the chosen word and the player must given an explanation of what the word means.

Green:

The dictionary holder must decide if the player has given as an answer a word which means the same as the chosen word or an answer which means the opposite of the chosen word. The dictionary holder reads out the word and says "same" or "opposite". The player must give an answer to the question in one word.

Yellow:

The dictionary holder reads out the first and last letters of the chosen word. The player must give as an answer a word which begins and ends in the same two letters. The length of the given word is to be determined by the number shown in the die. If, for instance, the numeral 3 is showing on the die, the players answer must contain at least three letters or more.

Brown:

The dictionary holder reads out the first letter of the chosen word and gives the definition(s) of the word. The player must guess the word.

It will therefore be appreciated that the various tasks are similar in nature as they are all general and may apply to a large number of different information sources. Further, they are all word-related and educational in nature. Each task, however, has a varying level of difficulty and because they are all different, they provide a good deal of variety and fun in playing of the game. Because the tasks are very general, they leave a good deal of opportunity for interpretation of the game by the players. Indeed, there could be different general tasks set at the beginning of the game. The important point is that the game apparatus provides a single and versatile tool for player enjoyment and education using a chosen information source.

If the player performs the particular task correctly, the banker gives him a token 30 with a particular task code colour. This indicates that the player has successfully completed one of the required tasks indicated by his indicator card 11. There are then nine remaining tasks to be performed, the breakdown according to code being given on the indicator card 11. There is no penalty if the answer is incorrect and the player simply does not receive a token.

If the player must land his playing piece on a space for which he is not required to perform a task, the player may play for points. The player may win or lose a number of points equal to the number shown on the die and the banker will give the player point counters 40 to register the score. If, however, the answer is incorrect, the player must give points to the banker. If the player cannot give points back to the banker, he forfeits his place in the game. In lieu of handing back point counters 40, the player may hand back task code tokens 30, whereby one token is the equivalent of 15 points. Alternatively, the player may sell back "challenge" auxiliary cards 20, each having a value of 10 points or "double-up" auxiliary cards, each having a value of 5 points.

When the player's playing piece rests on an auxiliary space 7, the player is not required to perform one of the tasks. However, he does choose an auxiliary card 20, hereinafter referred to as an "option" card. The "double option" card allows a player at a later stage in the game to declare his intention and nominate two colours before throwing the die. The same colour may be nominated twice. If the player can move his playing piece to the first nominated colour after throwing the die, he then performs the appropriate task and if correct, he has the opportunity to answer a question on the second nominated colour without having to throw the dice. It will therefore be appreciated that a "double-up" card provides the opportunity for a player to win two tokens 30 at the one play. If, however, the player only performs the first task correctly, he still wins one token card. If he cannot move to the first colour, or performs the first task correctly, the particular play ends.

Another variation for play using a "double-up" card is to nominate two colours, wherein one colour is required for the player's indicator card and the other not being required. In this case, the second colour may be used to win points. In this case, if the player cannot move to the first nominated colour, play ends and the player loses the number of points shown on the die. If the player cannot perform the first task correctly, the play ends and the player loses nothing. If the player can only perform the first task correctly, the play ends and the player wins one token 30. If the player performs both tasks correctly, the play ends and the player wins one token 30 and the appropriate number of points. A still further variation is whereby both nominated colours are used to gain points as neither are required by the player's indicator card. In this case, if the player cannot move to a space of the first nominated colour, the play ends and the player loses the points on the die. If the player cannot answer a first question, the play ends and the player loses nothing. If the player can only answer the first question, the play ends and the player wins the points indicated on the die. If the player answers both questions, the play ends and the player wins double the number of the points on the die.

Another type of auxiliary card 20 is a "challenge" card. When a player receives a "challenge" card, he may use it at a later stage to challenge another player during his play. Before the other player throws the die, the "challenger" must declare his intention. Instead of the person to the player's left holding the dictionary, the challenger holds the dictionary and he leafs through the dictionary until told to stop by the player. However, instead of the player picking location for a word which is to form the basis of the task, the challenger may pick any word from the two pages for the task to be performed. This of course allows the challenger to choose a difficult word for performance of the task and therefore possibly hinder another player's program.

The other option cards as shown in FIG. 3(*b*) are used in a self-evident manner. When a player chooses such a card, he may lose five points, win fifteen points or win or lose a particular type of token.

It will be appreciated in general that the auxiliary cards 20 provide auxiliary aspects to the playing of the game which provide additional versatility and excitement to players. However, these features are provided in a "modular" fashion whereby if the players are quite young or for some other reason it is decided not to use the auxiliary cards, they may be easily left out and where a player's playing piece rests on an auxiliary space 7, it can simply be ignored and the player does not perform a task and his turn ends. In this case, the game is played wholly by performing tasks as directed by the task code spaces 8. Again, the game may be as simple or as complex as the players desire, the auxiliary aspects being provided in a modular fashion. Of course, the primary aspect of the game is performing the various general, word-related tasks according to the task code spaces 8.

It will be appreciated that the game provides for both enjoyment and education of players in an extremely versatile manner. The nature of the tasks to be performed may be as difficult or as easy as the players choose and may have different levels of difficulty for different players by provision of different knowledge sources. In effect, it could be said that the apparatus provides a tool which allows enjoyable use of knowledge sources by the players and is not an end in itself. This is a radically different approach from that which has heretofore been the case. This is because in the prior art, the approach has always been to provide the tasks which are to be undertaken and the game is restricted to these particular tasks. The apparatus has always been regarded as an end in itself, the approach of the present invention being to regard the apparatus as a tool to route the players to different knowledge sources as they desire a large degree of enjoyment.

The invention is not limited to the embodiments hereinbefore described. For example, instead of being colours, the codes may be of any different type such as patterns, or symbols. Further, the indicator cards may indicate the required number of tasks for each code in a different manner such as by simple textual indications. Furthermore, it is not essential that points be awarded to players and the game could be kept to simply winning or losing tokens. To win a game, the player who first completes the tasks of his indicator card wins. Alternatively, the game may have a time limit and the person who has most tasks successfully completed would win. Quantifying the number of tasks would involve a combination of counting the points, whereby each token represents a set number of points.

I claim:

1. A board game apparatus comprising:

a plurality of individually distinguishable playing pieces;

a board having marked spaces thereon defining at least one playing path, in which at least some of the spaces are each marked with a task code;

guide means for indicating a general, word-related task associated with each task code, said tasks to be performed with an external word information source chosen by players;

a plurality of tokens, each of which is associated with a task and being for use in recording successful completion by a player of the associated task when the player's playing piece rests on a space marked with the associated task code;

a plurality of requirement indicator cards, each indicator card having marked thereon a number associated with each of the task codes, the numbers indicating the number of associated tasks required for each code by a player holding the card; and a die for use in providing a random factor in determining the space upon which a player's playing piece will rest.

2. An apparatus as claimed in claim 1, wherein the numbers on each indicator card together have a common mathematical relationship.

3. An apparatus as claimed in claim 2, wherein the total of the numbers on each indicator card is common to all indicator cards, thereby indicating the same total number of tasks for each player.

4. An apparatus as claimed in claim 1, wherein the task codes are colours and the indicator cards have numerals marked as a foreground colour, a background colour being the associated code.

5. An apparatus as claimed in claim 1, wherein there are a plurality of intersecting paths on the board, intersections of the paths providing alternative routes for playing pieces to provide alternative task codes for a particular play.

6. An apparatus as claimed in claim 5, wherein there is a plurality of intersecting orbital paths.

7. An apparatus as claimed in claim 5, wherein there is a plurality of intersecting orbital paths and the board also has marked thereon a start space located centrally within the paths and being connected to the paths by radial paths.

8. An apparatus as claimed in claim 1, wherein the marked spaces are coded in a random sequence around each path.

9. An apparatus as claimed in claim 1, wherein at least some spaces have auxiliary codes marked thereon, said codes being associated with a set of cards indicating auxiliary playing features of the game.

10. An apparatus as claimed in claim 9, further comprising point counters, the counters being received by the players to register a point score for auxiliary features.

* * * * *